US005543603A

United States Patent [19]

Schmädig et al.

[11] Patent Number: 5,543,603

[45] Date of Patent: Aug. 6, 1996

[54] HEAT CONDUCTOR SUPPORT DISK

[75] Inventors: Harald Schmädig, Mörfelden-Walldorf; Hubert Klöck, Stockstadt, both of Germany

[73] Assignee: Kanthal GmbH, Mörfelden-Walldorf, Germany

[21] Appl. No.: 222,278

[22] Filed: Apr. 4, 1994

[30] Foreign Application Priority Data

Apr. 2, 1993 [EP] European Pat. Off. ..... 93105482

[51] Int. Cl.[6] ..... H05B 3/02

[52] U.S. Cl. ..... 219/550; 219/523; 219/536; 219/552; 373/127; 373/132

[58] Field of Search ..... 219/520, 521, 219/523, 546, 548, 538, 550, 406; 373/127, 132, 133, 134

[56] References Cited

U.S. PATENT DOCUMENTS

| | | | |
|---|---|---|---|
| Re. 30,838 | 12/1981 | Best | 219/550 |
| 3,045,097 | 7/1962 | Sellers | 219/539 |
| 3,846,621 | 11/1974 | Roos | 219/550 |
| 4,016,403 | 4/1977 | Best | 219/550 |
| 4,126,757 | 11/1978 | Smith, Jr. et al. | 13/25 |
| 4,179,603 | 12/1979 | Zeigler et al. | 219/538 |

FOREIGN PATENT DOCUMENTS 909756 3/1954 Germany .

*Primary Examiner*—Tu Hoang
*Attorney, Agent, or Firm*—Spencer & Frank

[57] ABSTRACT

A multi-apertured ceramic disk heat conductor support for use in a heating element for electrically heating industrial furnace installations. The ceramic disk has a center aperture extending between exterior surfaces on an axis of symmetry for receiving a supporting element. Further apertures extend are provided for receiving heat conductors. The further apertures are equidistantly disposed around at least one circle which is coaxial with the center aperture. The further apertures have a respective axial portion, and a respective widening portion at least at one end thereof which increases in diameter from the axial portion toward a respective exterior surface of the ceramic disk. A rounded transition region between the axial portion and the widening portion is provided and the length of the axial portion is less than one-half the thickness of the ceramic disk.

17 Claims, 3 Drawing Sheets

HEAT CONDUCTOR SUPPORT DISK

CROSS REFERENCE TO RELATED APPLICATION

This application claims the priority of European Patent Application Serial No. EP 93 10 5482.9, filed on Apr. 2, 1993 in the European Patent Office, the subject matter of which is incorporated herein by reference.

BACKGROUND OF THE INVENTION

1. Field of the Invention

The invention relates to the field of heating elements for industrial electrical furnace installations, and in particular to a heat conductor support disk for use in a heating element.

2. Background Information

So-called heating plugs used in industrial furnaces are constructed with the help of several ceramic disks. The purpose of the ceramic disks is to support and position heating resistor elements or heat conductors which are inserted through apertures in the disks.

In such disks, a center aperture for a supporting element is located on a symmetrical axis of each disk, and apertures for heat conductors are provided uniformly distributed on at least one circle coaxial with a respective disk center.

In this type of heating plug, the ceramic disks are spaced apart and arranged parallel to one another, with the supporting element, which is usually a rod or tube, being inserted through the center apertures of the ceramic disks. This disk and supporting element configuration is usually pushed into a protective tube generally made of either metal or a ceramic material. The protective tube is also known as a radiant tube because during operation it emits heat toward the exterior.

Due to thermal deformation effects of the components, there must be a certain play between the exterior circumference of the heating plug and the interior diameter of the protective tube. However, the heating element may also be built into a thermic installation as a freely radiating and operating heating element.

The exterior circumference of these ceramic disks is usually circular, and all the apertures of the ceramic disks have diameters which remain the same over their entire length.

In order for the heating elements to function, it is, among other things, essential for the heat conductors to be constantly supplied with oxygen. This is because the heat conductors and the other metal members of the heating element comprise an aluminum-containing alloy, particularly if a higher range of temperatures is to be obtained. During operation, the oxygen is combined with the aluminum in the alloy and forms $Al_2O_3$. The formation of this oxide (ceramic) is desired because it essentially increases the service life of the heating element. The described phenomena are known.

In prior art heating elements, the metal members of the heating elements are supplied with oxygen but generally not in sufficient quantities. The reason for this is that each of the ceramic disk forms a barrier for the oxygen (air) which is to flow through the heating element, all apertures in the ceramic disk being almost completely filled with heat conductors and the supporting element. Also, at the outer circumference of a ceramic disk, there is only a very narrow clearance (slit) between the exterior circumference of the disk and the protective tube, whose size additionally depends on the respective temperature.

These types of heating elements are frequently provided with thermoelements. These thermoelements are rod shaped and may extend over the length of the heating element. In this case, it is known to provide one sole recess at the circumference of each ceramic disk and then to place the thermoelement into the mutually aligned recesses. However, the installation in this case is very cumbersome and expensive, because attention must always be paid that the mentioned recesses are aligned with one another.

It is a further drawback of the described prior art construction that the heat conductors make contact with the ceramic disks via a circular region over a considerable distance due to the bores (apertures) which accommodate the heat conductors. As mentioned earlier, the diameter of these bores is uniform over their entire length. Since the ceramic disks are poor heat conductors, heat accumulates in this region, thereby not only causing deterioration in the degree of effectiveness of the heating elements, but particularly causing the ceramic disks to act on a relatively wide circular region on each heat conductor, causing the latter to be damaged in the process. This is the result of thermal deformations, which are often significant.

The above-described prior art has been previously employed by the applicants. However, the applicants are also aware of modifications used by other firms which are described in more detail below. However, these modifications of multi-aperture disks as heat conductor supports are apparently not intended for industrial furnace construction, but instead, for use at relatively low temperatures.

In one prior art modification of a multi-aperture disk, recesses, which are approximately semi-circular having circular edges, are evenly distributed over the entire circumference of the disk. These recesses are spaced apart with respect to one another such that a portion of the original disk edge (circular) remains between each respective recess.

However, this has the drawback that the transition between the approximately semi-circular recesses and the original circular disk are relatively sharp edged. These sharp edges can consequently break off during operation and, particularly if the heating element is arranged horizontally, the sharp edges act on the interior surface of the protective tube and may destroy the oxide layer there.

In the case where the heating element is arranged horizontally, two things can happen: (1) the ceramic disks make contact with the portion of their exterior circumference remaining on the interior surface of the protective tube resulting in a disadvantageous single-point contact, since there must be a certain play between the exterior diameter; or (2) the disks rest with two adjacent edges on the interior side of the protective tube. Although this defines the contact, it occurs at the expense of possibly damaging the interior wall of the protective tube caused by the action of the sharp edges.

In the modification already mentioned, the apertures supporting the heat conductors are chamfered, apparently in order to prevent damage to the ceramic material during the assembly process of pulling the ceramic disks onto the heat conductors. In a prior art modification, the chamfering depth is 2 mm if the total length of the bore is 11.2 mm. In another modification, the chamfering depth is approximately 4 mm for a total bore length of approximately 12 mm.

Another known modification has the mentioned recesses at the edge of the ceramic disk having smoothly penetrating bores, while two other modifications are provided with the mentioned recesses at the circumference of the ceramic disk. Other modifications, again, show ceramic disks without the mentioned recesses and without the chamfering.

There is another available type of multi-aperture ceramic disk some variations of which also have the previously mentioned chamfering on the order of magnitude of 2×1 mm for a 15 mm total length of bore. However, other disks of this type do not have chamfering, and none of these ceramic disks have recesses at the edge of the disk. Here chamfering also apparently merely serves to protect the edges of the bores.

A further prior art modification involves this type of ceramic disk without recesses at the edge of the disk, but with two circular apertures. The outer aperture has circular aperture chamfering. In one variation, the aperture extends the entire thickness of the disk, the entire length of the bores being 16 mm and the chamfering being 2×5 mm long. In a second variation of this type of disk, the disk is 19 mm thick and the chamfering is also 2×5 mm long. Although in the first disk, the chamfering scarcely extends over half of the entire length of the bores, the second disk indicates that there too, attention was only focused on edge protection.

It should be further pointed out that in all known prior art multi-aperture ceramic disks, a transition between an inner (central) portion of the bore and the chamfering is edged. This has the disadvantage that the circular edges may damage the surface of the heat conductor to an increased extent.

SUMMARY OF THE INVENTION

The present invention eliminates the above-mentioned drawbacks of the prior art. An object of the invention is to provide a heat conductor support disk having characteristics which particularly result in markedly reducing the danger of damaging heating elements equipped with this type of disk.

According to one embodiment of the invention, a multi-apertured ceramic disk heat conductor support for use in a heating element for electrically heating industrial furnace installations, comprises a ceramic disk having exterior surfaces, an edge, a thickness and an axis of symmetry, a center aperture being provided extending between the exterior surfaces on the axis of symmetry for receiving a supporting element. The ceramic disk has a plurality of further apertures extending between the exterior surfaces of the disk for receiving heat conductors. The plurality of further apertures are equidistantly disposed around at least one circle which is coaxial with the center aperture. The plurality of further apertures each a respective axial portion and a respective widening portion at least at one end thereof which increases in diameter from the axial portion toward a respective exterior surface of the ceramic disk. The further apertures each a rounded transition region between the axial portion and the widening portion and the length of the axial portion is less than one-half the thickness of the ceramic disk. The axial portion of the bore is preferably it is less than one fourth of the thickness of the disk.

Due to the aforementioned rounded transition, the danger of damaging the exterior side of the heat conductors which are inserted into the apertures is markedly decreased. Deviating from edge protection of the apertures or bores, which is the object of the chamfering in the prior art, the length of the bores by way of which the heat conductors contact the material of the ceramic disk is essentially decreased by comparison. This advantageously decreases the danger of damaging the surface of the heat conductor because the contact surface is markedly smaller.

Moreover, improved radiation conditions for the heat conductor are obtained, reducing the danger of overheating. The shorter contact of the heat conductor (resistor) minimizes oxide abrasion on the surface of the heat conductor.

The length of the axial portions of the bores with respect to the thickness of the disk, and thus to the entire length of the bores, may be set forth in relative terms as described above. However, it may also be done by indicating absolute lengths. Here too, the length depends on the respective thickness of the disk. Good results are obtained through a preferred embodiment of the invention if the axial portion of the bore is maximally 5 mm long and preferably between 0.5 mm and 2 mm to 3 mm long.

It should also be mentioned that with respect to percentage, the axial portion of the bore in thinner disks tends to be selected higher than with thicker disks. However, in a constant effort to keep the contact surface as small as possible, in thick disks, the limit of one fourth of the disk thickness is not exceeded.

According to another advantageous aspect of the invention, a ceramic disk having the characteristics defined above further comprises a plurality of recesses symmetrically distributed around the edge of the disk. The recesses provided at the circumference of the ceramic disk have wavy edges with circular peaks and valleys of the wavy shapes and with constant transitions between the circular segments. This eliminates the sharp-edged transitions of the described prior art and the accompanying drawbacks.

It is preferable if the apertures of the outermost ring (circle) of apertures are arranged in such a way with respect to the wavy shaped edge that respective distances between the edge of the disk and the outer ring of apertures are as uniform as possible. That is, a distance, which remains as uniform as possible, is created between these apertures and the wavy edge. The respective apertures, seen from the interior of the disk, should be preferably disposed in the radial direction below the "peaks" of the wavy shape. The distances from the edge of the disk thus obtained and as uniform as possible, reduce loads during thermal deformation and thus prolong the service life of the construction also.

In another advantageous embodiment of the invention, a heat conductor support assembly is comprised of a plurality of disk supports according to the invention. In the heat conductor support assembly, the respective disks are spaced apart and arranged parallel to one another. Central apertures are disposed at the center of each disk, for receiving a supporting element, the supporting element being inserted through the respective central apertures of the disks. A protective radiant tube is provided, the plurality of disk supports and the supporting element being disposed within the protective radiant tube.

BRIEF DESCRIPTION OF THE DRAWINGS

The above and other features of the invention will become apparent from the following detailed description taken with the drawings in which.

DETAILED DESCRIPTION OF THE PREFERRED EMBODIMENTS

Figure 1:
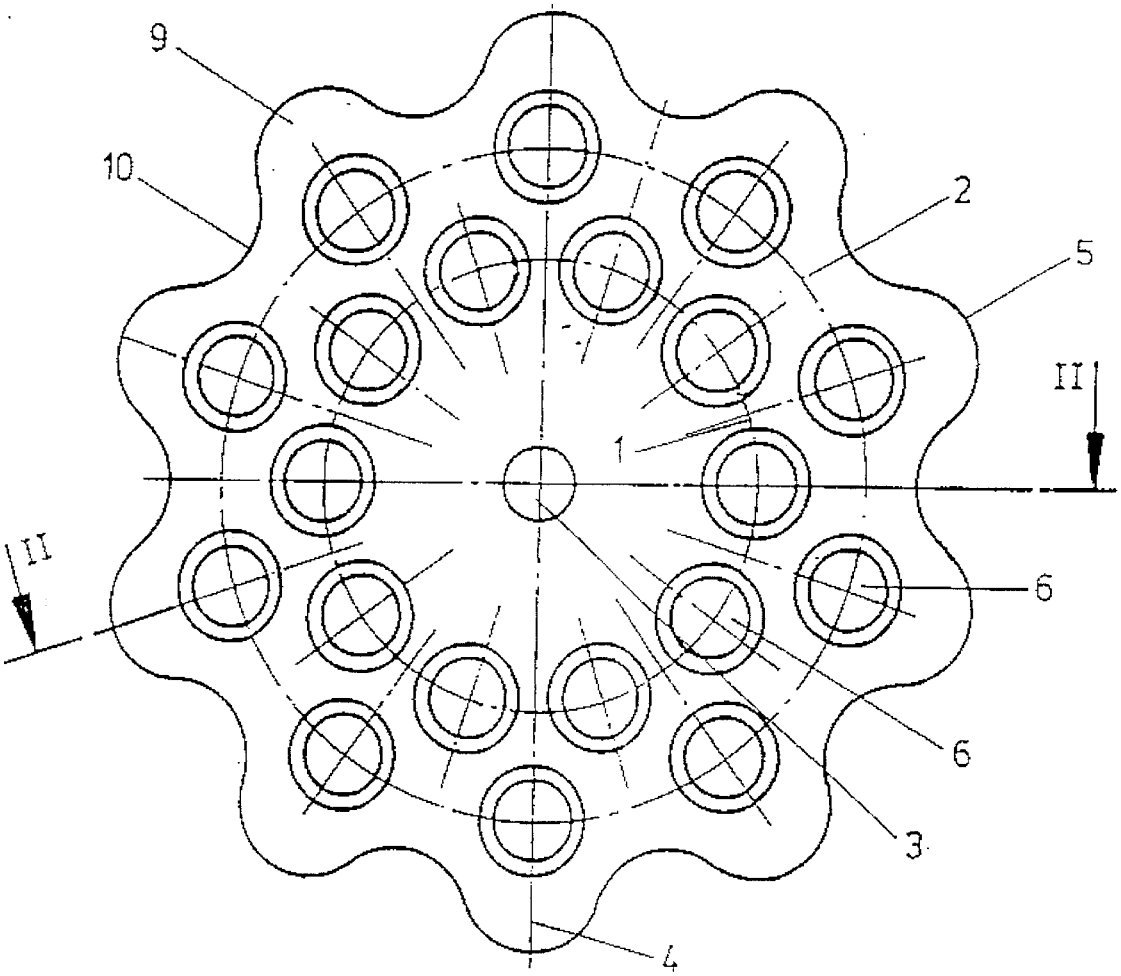
FIG. 1 is a view of a ceramic disk according to the invention.
Figure 4:
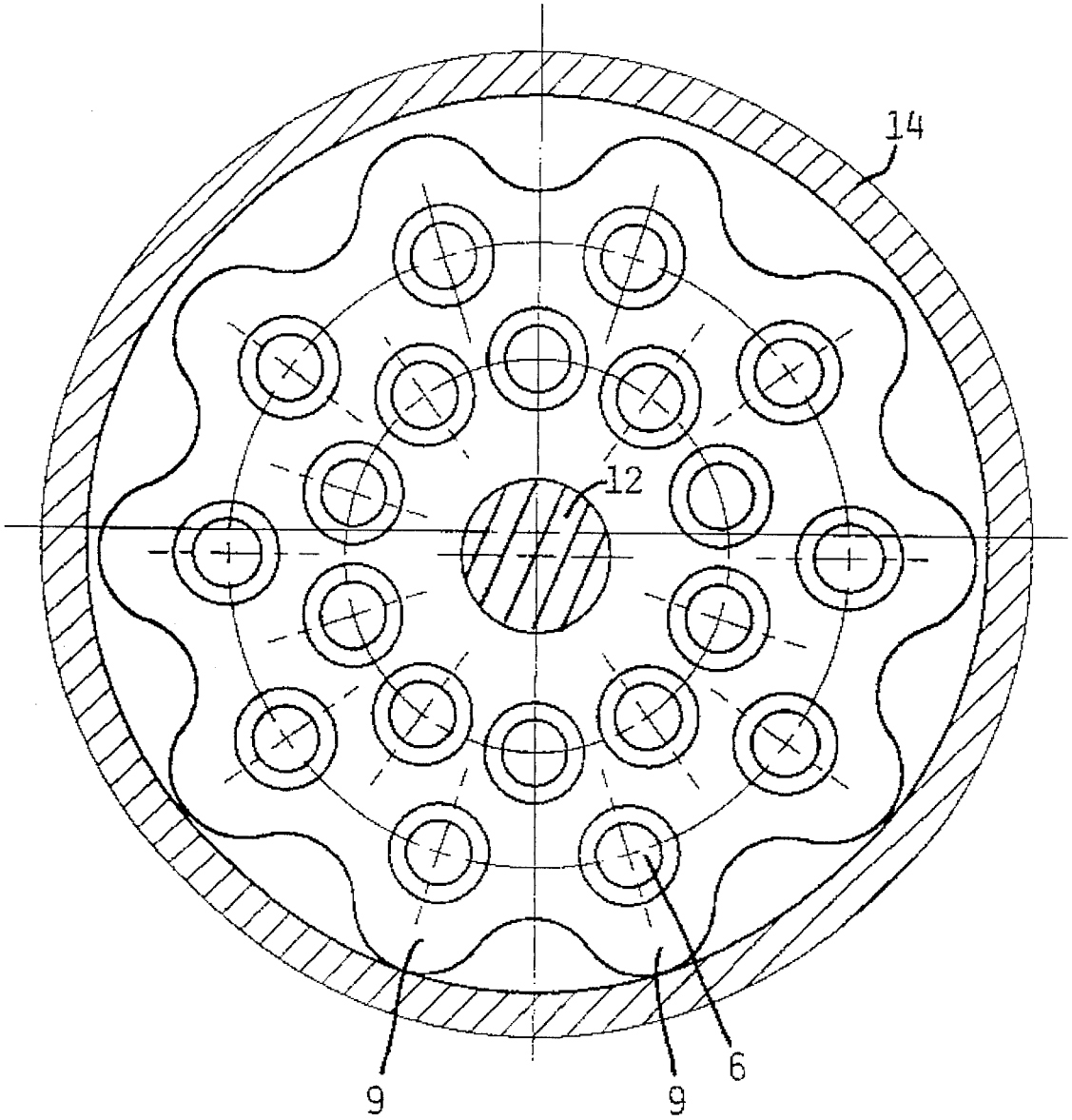
FIG. 4 is a sectional view of a heat conductor support assembly according to the invention.

In an exemplary embodiment of the invention shown in FIG. 1, a ceramic disk including an inner ring of apertures 1 and an outer ring of apertures 2 for receiving heat conductors. In other embodiments (not shown), at least one of these rings of apertures 1, 2 is provided. Additionally, the ceramic disk has a central support means receiving aperture 3 on its axis of symmetry for receiving a supporting element 12 (FIG. 4). At its circumference, the disk has an edge 5 in the form of a wavy line.

Figure 2:
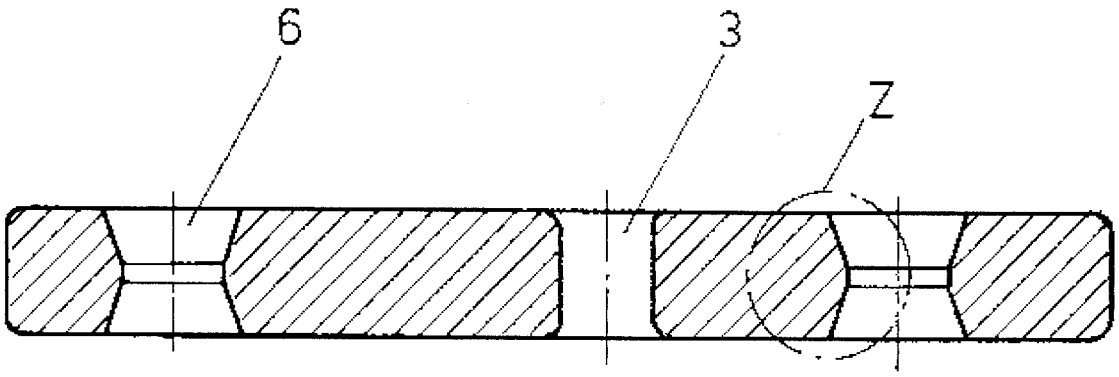
FIG. 2 is a cross section along lines II—II of FIG. 1.
Figure 3:
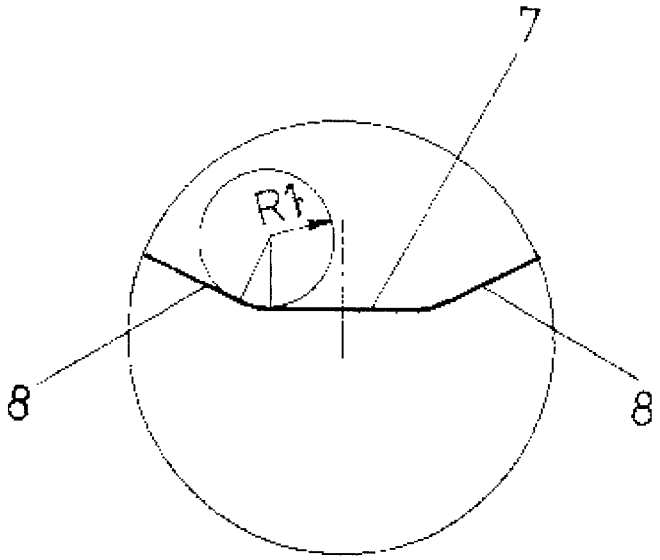
FIG. 3 is an enlarged detail Z of FIG. 2.

FIGS. 2 and 3 show that the apertures 6, forming rings of apertures 1, 2, are provided with an central, relatively narrow axial portion 7 which extends parallel to the axis of the central aperture 3. Referring to FIG. 3 which is an enlarged area Z of FIG. 2, contiguous with axial portion 7 are widening portions 8, rounded transition regions between portions 7 and 8 being shown by radius R1. Thus, the diameter of the apertures 6 widen toward the exterior surface of the disk along portions 8.

The aperture bore arrangement shown in FIGS. 2 and 3 however need not be symmetrical. For example, in an extreme case, axial portion 7 may be provided at one end of the aperture 6 so that, in this case, only one of the widened segments 8 is provided.

FIG. 2 additionally shows that the center aperture 3 may be chamfered in order to protect the edges thereof, just as in the prior art described in the introduction section. Thus, FIG. 2 also illustrates the qualitative difference between the form of apertures 6 according to the present invention and the prior art.

With reference again to FIG. 1, it can be seen that the wavy shape of the edge 5, seen from the center of the disk, is formed by sections 9, which extend outwardly by a predetermined radius, and by sections 10 which are contiguous with them and which, with a predetermined radius, form the indentation of the wavy shapes. The transitions between these radii or sections 9, 10 are advantageously continuous and smooth. The radii of both sections 9, 10 need not be equal, but they should preferably not vary too much.

Some preferred dimension for an exemplary disk according to the invention are as follows,. The exterior diameter lies between 30 and 500 mm, preferably between 40 and 200 mm. The thickness lies between 5 and 30 mm, preferably between 8 and 20 mm.

At least one of the rings of apertures 1,2 is provided. The number of apertures per ring of apertures may be between 2 and 70, and is preferably between 4 and 24. The diameter of the aperture lies between 3 and 30 mm, preferably between 5 and 15 mm.

A suitable ceramic material is selected for the disk. This material is, for example, temperature resistant up to at least 1,300° C. and is characterized by a high resistance to temperature changes. For example, a ceramic material having at least 70% of $Al_2O_3$ may be used.

Due to the selected outer contour of wavy edge 5, improved convection is obtained inside the protective tube. The oxygen exchange improved in this manner in turn improves oxidation of the heat conductor and of the tube. FeCrAl is the preferred material in this case.

The uniform distance between the apertures of the outer ring 2 and the wavy edge 5 advantageously renders the ceramic disk more resistant to temperature changes.

In constructions which are oriented horizontally or sloped, a two-point linear contact of the disk occurs on the inner surface of the protective radiant tube 14, namely, on two adjacent peaks 9 (FIG. 4). This results in an improved weight distribution and a reduced danger of breakage.

The installation of a thermoelement is also facilitated according to the invention. In this case, the disks no longer need to be oriented in one direction as would be the case with a sole recess. The heat conductors which are guided through apertures 6, guarantee that the peaks and valleys 9, 10 on the disks of the components are all aligned with one another.

If forced ventilation is required, the simple installation of tubes (e.g., ceramic tubes) is realized combined with the improved oxidation of the heat conductor, and rapid cooling by means of the forced ventilation is also possible.

The angle of the chamfering on the heat conductor apertures 6 should preferably be between 20° and 25°. The rounded transition R in FIG. 3 should preferably be between 0.75 and 1.25 mm.

As a result of chamfering, sharp edges are avoided with a reduced danger of damaging the heat conductor surface. For example, in a heat conductor made of FeCrAl, the protective oxide of the material is no longer in danger of being seriously damaged. Resulting improved radiation conditions for the heat conductor are also of importance, and result because only the very narrow circular space in the region of axial portion 7 is blocked or covered by the ceramic disk material. The result is a marked reduction in the danger of overheating. Further, the reduced disk contact surface in the region of axial portion 7 minimizes oxide abrasion.

It will be understood that the above description of the present invention is susceptible to various modifications, changes an adaptations, and the same are intended to be comprehended within the meaning and range of equivalents of the appended claims.

What is claimed:

1. A multi-apertured ceramic disk heat conductor support for use in a heating element for electrically heating industrial furnace installations, comprising:

a ceramic disk having exterior surfaces, an edge, a thickness and an axis of symmetry, a center aperture being provided extending between the exterior surfaces on the axis of symmetry for receiving a supporting element;

the ceramic disk having a plurality of recesses symmetrically distributed around the edge of the disk, the recesses being defined by a plurality of circular segments forming alternating circular valleys and circular peaked regions, there being continuous transitions between the circular segments, thereby forming the edge with a wavy shape;.

the ceramic disk having a plurality of further apertures extending between the exterior surfaces of the disk for receiving heat conductors;

wherein the plurality of further apertures are equidistantly disposed around at least one circle which is coaxial with the center aperture to form a ring of apertures, wherein a distance formed between each respective further aperture and the edge at each respective peaked region is essentially uniform.

2. The ceramic disk heat conductor support according to claim 1, wherein the axial portion is not greater than 5 mm in length.

3. The ceramic disk heat conductor support according to claim 2, wherein the length of the axial portion is between 0.5 mm and 2 mm.

4. The ceramic disk according to claim 1, wherein the axial portion is less than one fourth the thickness of the ceramic disk.

5. A method of supporting heat conductors in a heating element for electrically heating industrial furnace installations, the method comprising utilizing at least one ceramic disk heat conductor support according to claim 1.

6. A method of supporting heat conductors in a heating element for electrically-heating industrial furnace installations, the method comprising utilizing a plurality of the ceramic disk heat conductor supports according to claim 1.

7. The ceramic disk heat conductor support according to claim 1, wherein each of said further apertures has two ends, a respective axial portion, and a respective widening portion at least at one end of said further aperture which increases in diameter from the axial portion toward a respective exterior surface of the ceramic disk;

wherein each of the further apertures has a rounded transition region between the axial portion and the widening portion; and wherein the length of the axial portion is less than one-half the thickness of the ceramic disk.

8. A heating element support comprising:

a disk having exterior surfaces, an edge, a thickness, a center and an axis of symmetry, the center being disposed on the axis of symmetry;

the disk having a plurality of recesses symmetrically distributed around the edge of the disk, the recesses being defined by a plurality of circular segments forming alternating circular valleys and circular peaked regions, there being continuous transitions between the circular segments, thereby forming the edge with a wavy shape; and heat conductor aperture means, extending between the exterior surfaces of the disk, for receiving heat conductors, the aperture means being equidistantly disposed around at least one circle on the disk, the circle being coaxial with the center of the disk to form a ring of heat conductor aperture means, wherein a distance formed between each respective heat conductor aperture means and the edge at each respective peaked region is essentially uniform.

9. The support according to claim 8, wherein the disk is formed of a ceramic material.

10. The support according to claim 9, wherein the ceramic material is temperature resistant up to at least 1,300° C. and has a high resistance to temperature changes.

11. The support according to claim 9, wherein the ceramic material is a ceramic material having at least 70% of $Al_2O_3$.

12. The support according to claim 8, wherein the disk further comprises a central aperture means, disposed at the center of the disk, for receiving a supporting element.

13. A method of supporting heat conductors in a heating element for electrically heating industrial furnace installations, the method comprising utilizing at least one support according to claim 8.

14. The heating element support according to claim 8, wherein each of the heat conductor aperture means has two ends, a respective axial portion, and a respective widening portion at least at one end of said heat conductor aperture means which increases in diameter from the axial portion toward a respective exterior surface of the disk;

wherein each of the heat conductor aperture means has a rounded transition region between the axial portion and the widening portion; and wherein the length of the axial portion is less than one-half the thickness of the disk.

15. A heat conductor support assembly comprising a plurality of heating element supports, each heating element support including:

a disk having exterior surfaces, an edge, a thickness, a center and an axis of symmetry, the center being disposed on the axis of symmetry;

the disk having a plurality of recesses symmetrically distributed around the edge of the disk, the recesses being defined by a plurality of circular segments forming alternating circular valleys and circular peaked regions, there being continuous transitions between the circular segments, thereby forming the edge with a wavy shape; and heat conductor aperture means, extending between the exterior surfaces of the disk, for receiving heat conductors, the aperture means being equidistantly disposed around at least one circle on the disk, the circle being coaxial with the center of the disk to form a ring of heat conductor aperture means, wherein a distance formed between each respective heat conductor aperture means and the edge at each respective peaked region is essentially uniform.

16. The heat conductor support assembly according to claim 15, wherein the plurality of supports are spaced apart and arranged parallel to one another, wherein the heating element supports further comprise central aperture means, each disposed at the center of each disk, for receiving a supporting element, the supporting element being inserted through the respective central aperture means of the disks, and said heat conductor support assembly further comprising a protective radiant tube, wherein the plurality of supports and the supporting element are disposed within the protective radiant tube.

17. A heat conductor support assembly, comprising:

a plurality of ceramic disks, each a ceramic disk having exterior surfaces, an edge, a thickness and an axis of symmetry, a center aperture being provided extending between the exterior surfaces on the axis of symmetry for receiving a supporting element;

each ceramic disk having a plurality of recesses symmetrically distributed around the edge of the disk, the recesses being defined by a plurality of circular segments forming alternating circular valleys and circular peaked regions, there being continuous transitions between the circular segments, thereby forming the edge with a wavy shape;

each ceramic disk having a plurality of further apertures extending between the exterior surfaces of the disk for receiving heat conductors;

wherein the plurality of further apertures are equidistantly disposed around at least one circle which is coaxial with the center aperture to form a ring of apertures, wherein a distance formed between each respective further aperture and the edge at each respective peaked region is essentially uniform.

* * * * *